US007384174B2

(12) United States Patent
Ejnesman

(10) Patent No.: US 7,384,174 B2
(45) Date of Patent: Jun. 10, 2008

(54) ARTICULATING LIGHTING SYSTEM AND LAMP FRAME

(75) Inventor: Samuel Ejnesman, 77 Quebec Avenue, Suite 1828, Toronto, Ontario (CA) M6P 2T4

(73) Assignee: Samuel Ejnesman, Toronto, Ontario (CA)

( * ) Notice: Subject to any disclaimer, the term of this patent is extended or adjusted under 35 U.S.C. 154(b) by 178 days.

(21) Appl. No.: 10/532,777

(22) PCT Filed: Oct. 23, 2002

(86) PCT No.: PCT/CA02/01600

§ 371 (c)(1),
(2), (4) Date: Apr. 22, 2005

(87) PCT Pub. No.: WO2004/038287

PCT Pub. Date: May 6, 2004

(65) Prior Publication Data

US 2006/0044811 A1 Mar. 2, 2006

(51) Int. Cl.
*F21V 11/00* (2006.01)

(52) U.S. Cl. ..... 362/351; 362/281; 362/278

(58) Field of Classification Search ..... 362/319–322, 362/351, 352, 355, 356, 357, 433, 806
See application file for complete search history.

(56) References Cited

U.S. PATENT DOCUMENTS

| | | | | |
|---|---|---|---|---|
| 1,701,149 | A | 2/1929 | Eha | |
| 2,080,786 | A * | 5/1937 | Robles | 220/252 |
| 4,422,441 | A * | 12/1983 | Schoepe | 126/299 C |
| 4,734,837 | A | 3/1988 | Blackman et al. | |
| 5,542,560 | A | 8/1996 | Gerster et al. | |
| 6,431,393 | B1 * | 8/2002 | Stewart | 220/826 |

FOREIGN PATENT DOCUMENTS

| | | | |
|---|---|---|---|
| GB | 496 326 | A | 11/1938 |

* cited by examiner

*Primary Examiner*—Hargobind S Sawhney
(74) *Attorney, Agent, or Firm*—Roberts, Mlotkowski & Hobbes P.C.

(57) ABSTRACT

An articulating lighting system and lamp frame (1) with many configurations in use and installation by rotation of frame components (2, 3) about a central axis (4).

26 Claims, 7 Drawing Sheets

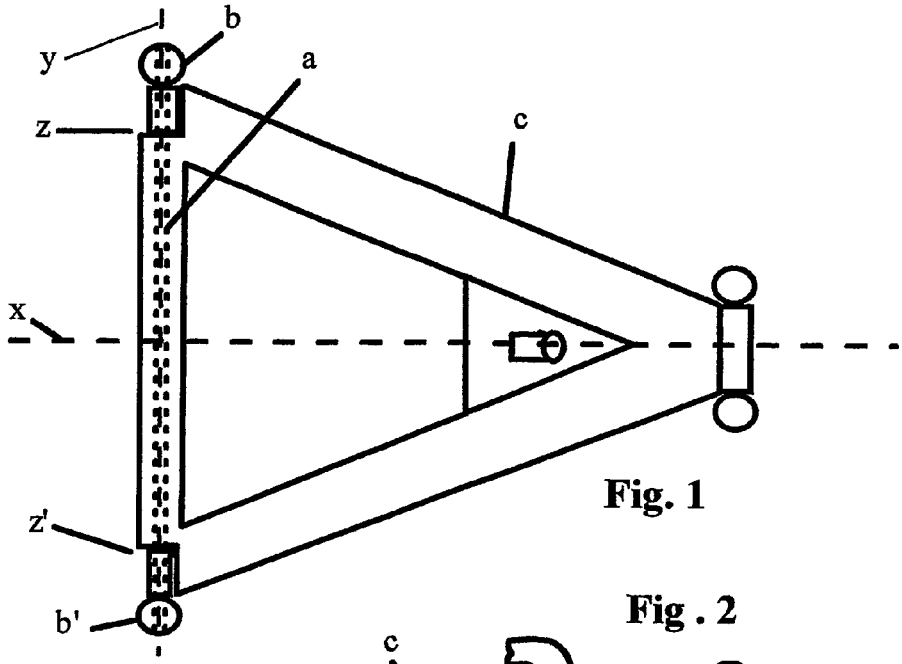
Fig. 1
Fig . 2
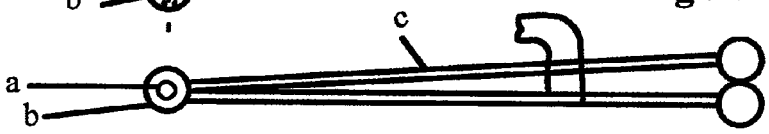
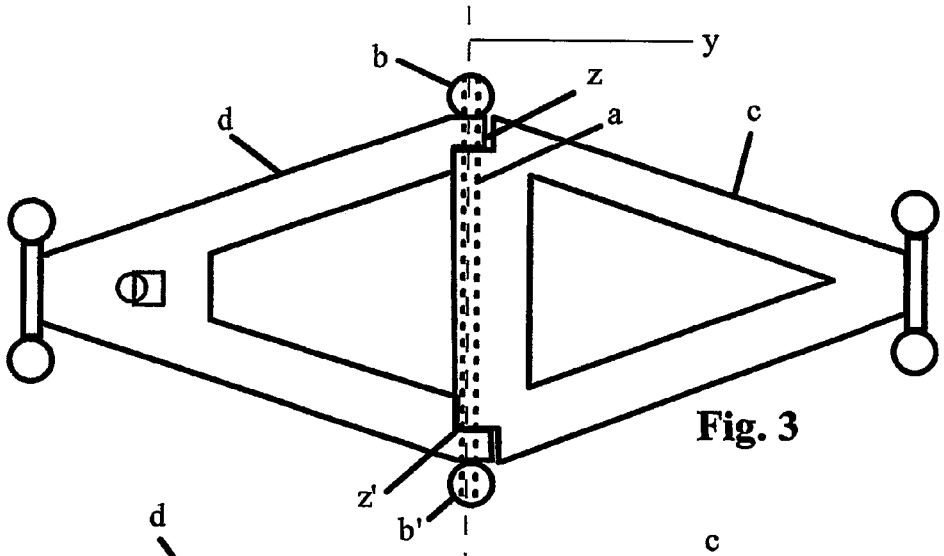
Fig. 3
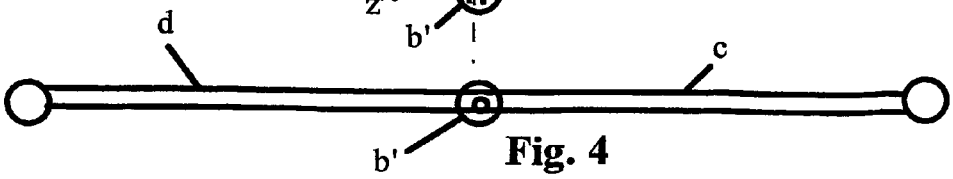
Fig. 4

Fig. 7
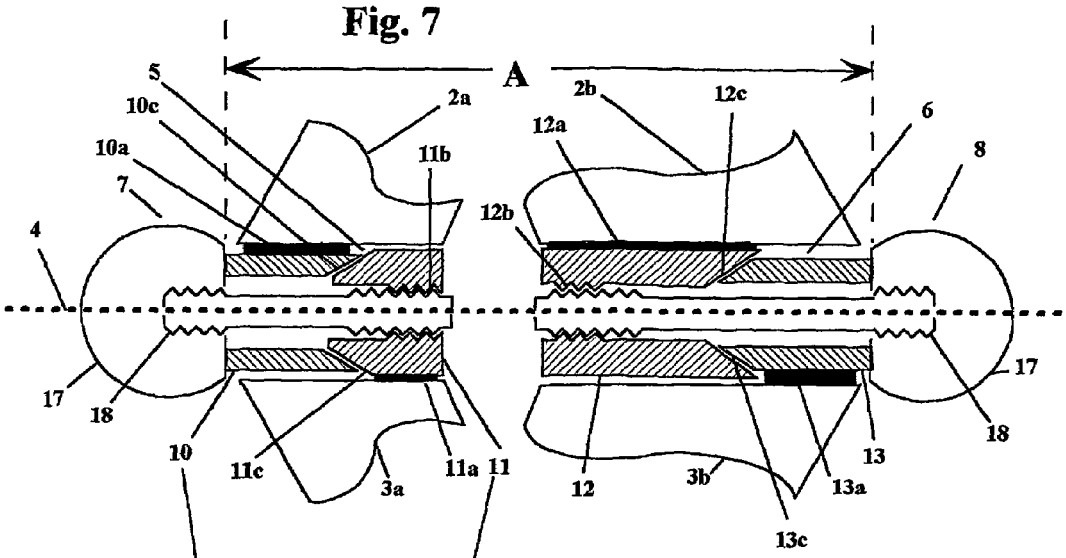
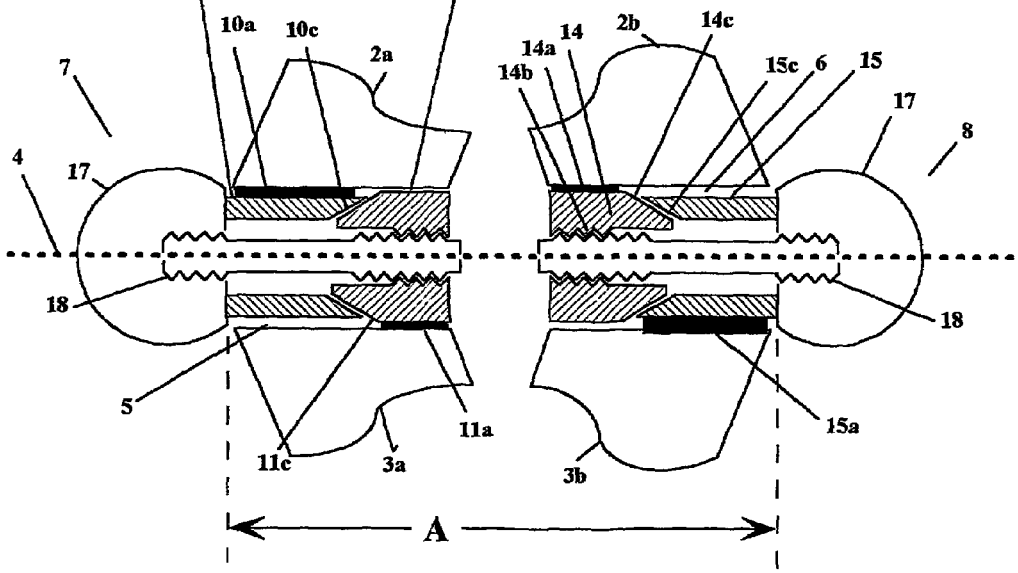
Fig. 8

ARTICULATING LIGHTING SYSTEM AND LAMP FRAME

BACKGROUND

Of late, heightened consciousness of energy conservation has resulted in low power consumer lamps or light bulbs which are fluorescent rather than incandescent. Although these are more efficient than standard bulbs and generate less heat they typically are perceived as providing less light and often require closed shades to soften the harshness of the fluorescent light. A similar situation occurs with other types of energy efficient light bulbs.

Such bulbs are not always consistent with traditional lamp frames of a specific shape and configuration or where light output is restricted as in U.S. Pat. No. 4,734,837. Further, the high initial cost of these bulbs adds to the increasing high cost of lighting fixtures.

The process of designing a light fixture, apart from aesthetic considerations, takes into account the light's intended function, including positioning and lighting direction, and safety issues. The latter arise from the high heat of traditional incandescent bulbs which require adequate ventilation. This is often provided with an open-ended shade. A base of heavy non-flammable material also protects the user. The result is often single purpose lighting fixtures that fall into wall, table, floor or ceiling categories with little or no flexibility.

PRIOR ART

The prior art includes a variety of articulating lamp bases. The high heat expectation of the typical incandescent bulb has required close attention to the limits of any small shade type and barriers between the lamp and the exterior of the fixture. Of particular note is the lamp base disclosed in U.S. Pat. No. 4,734,837. A winged base is shown with a folding shade which is inter-linked with electro-mechanical parts to provide a varying degree of illumination by changing the energy delivered to the lamp.

This lamp design has no flexibility and it directed to reducing the amount of illumination from standard bulbs as may be required by confining the emitted light with the lamp stand and shade. Any savings in energy use arise from variations in input energy to match the shade position. Each of the articulating portions is held in place by the mechanism and is not subject to a variety of stresses or uses.

Others are known wherein the lamp frame is based upon a foldable hinge with a central transverse axle. This foldable frame is depicted closed and open in FIGS. 1, 2 and 3, 4 in plan and side views respectively. Rigid hinge portions c and d articulate with respect to one another about the axle and are clamped by nut-like supports at each extremity. Although useful with attached shades the foldable frame lacks the restraint required for adequate stiffness as is required in ordinary use without the use of tools in an adaptable frame and interferes with the delivery of light to the exterior in many configurations.

The rigidity of the hinge portions c and d requires assembly along axis x for rotation around axis y. Mating hinge surfaces as at z and z' come into close contact requiring a degree of manufacturing precision. A threaded axle a is then inserted and held in place with nuts b and b'.

Any attempt to fix the position of hinge portions c and d by tightening nuts b brings mating surfaces z into frictional contact as portion c is rigid. User applied torque to nuts b and b' is distributed between surfaces z and z' and is not sufficient.

SUMMARY OF THE INVENTION

The present invention provides an adaptable lamp frame and lighting system or fixture which is simple and inexpensive to manufacture and provides the consumer with a wide variety of options in both lighting function and decoration without the use of extra tools and which can be conveniently packaged or stored. It is particularly adapted to function with low power consumer lamps and thereby provide full illumination throughout its various configurations. These include mountings of the lighting system and frame of the invention on flat surfaces such as wall, ceilings, floors or furniture, and about corners, whether at 90 degrees, 270 degrees or at any other angle. Attachment points are available for accessories so that the lighting system and frame may be used for a table or swag lamp or in multiples.

The present invention provides a lighting system including an articulating lamp frame with an open central area, support means to support a lamp adjacent the central area, a pair of substantially planar components attachable together for use by a pair of spaced apart hinges for relative rotation about a main axis extending between the hinges and across said central area, and where the hinges includes fixation means adapted to releasably fix the relative position of the planar components, and an extensible shade attached between said planar components.

The hinges are each provided by a pair of hinge elements aligned along main axis attached to a respective one of said components. Each of the hinge elements includes a threaded portion to receive a bolt and is adapted to apply compressive force to hinges along the main axis and to fix the relative position of the planar components upon tightening. A pair of non-axial contact surfaces between the hinge elements is adapted to come into frictional contact upon tightening.

The planar components are guided together by movement along the main axis upon attachment.

BRIEF DESCRIPTION OF THE DRAWINGS

FIGS. 1 and 2 depict a prior art articulating lamp frame in its closed position in plan and side view respectively.

FIGS. 3 and 4 depict the prior art lamp frame of FIGS. 1 and 2 in its half-open position in plan and side view respectively.

FIG. 7 shows the 2-part clamping hinge of the preferred embodiment.

FIG. 8 shows the 2-part clamping hinge of an alternative embodiment.

FIG. 14 shows the lamp frame 1 in plan view. FIG. 15 shows a side view of the table lamp frame fully assembled in side view.

FIG. 16 shows the lamp frame as a hanging lighting system or fixture. FIG. 17 as a table lamp or for attachment to a corner. FIG. 18 shows the lamp frame as a wall lamp or independent fixture.

DESCRIPTION OF THE PREFERRED EMBODIMENTS

Figure 5:
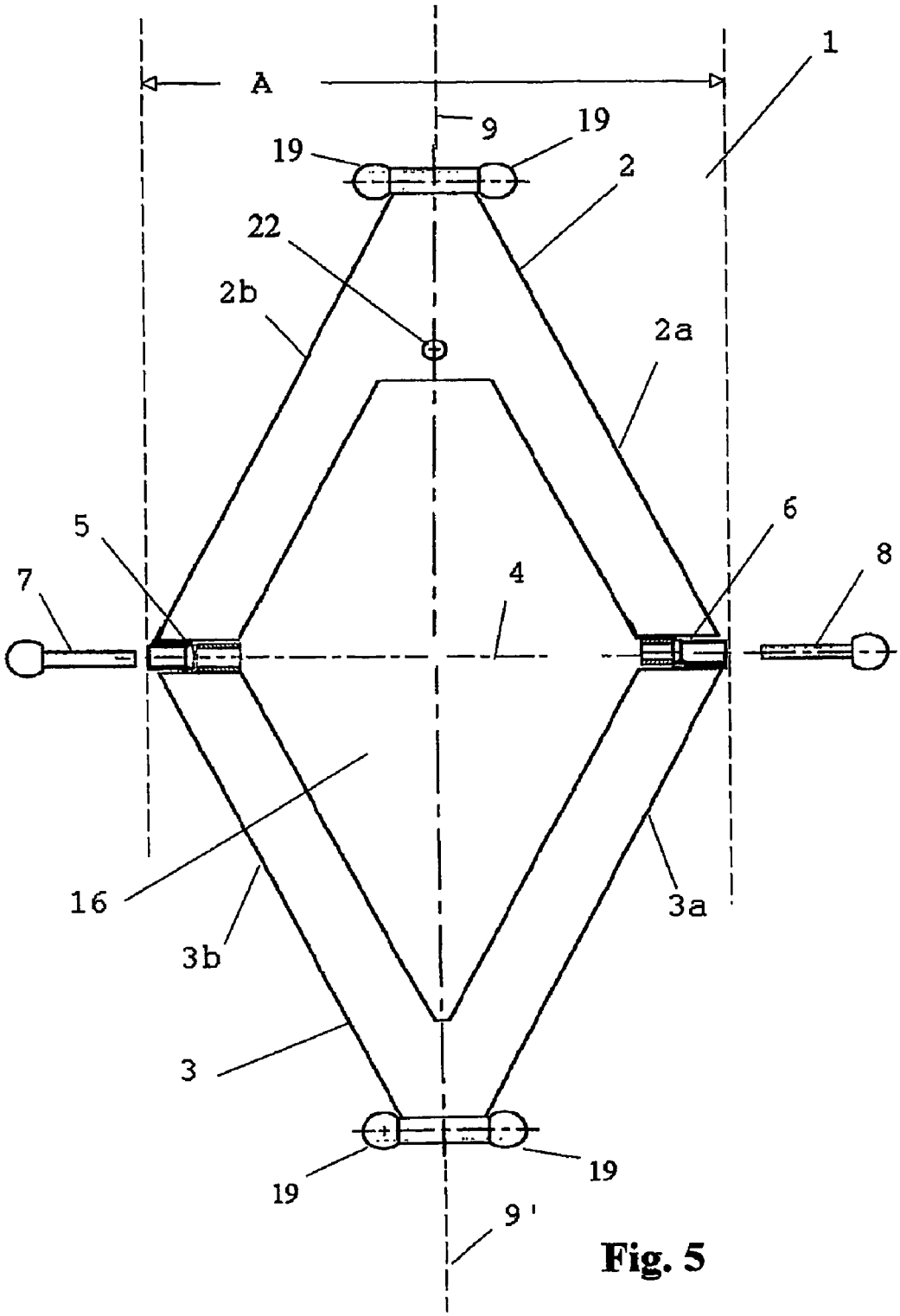
FIG. 5 shows the lamp frame of the preferred embodiment of the invention in half-open position.
Figure 6:
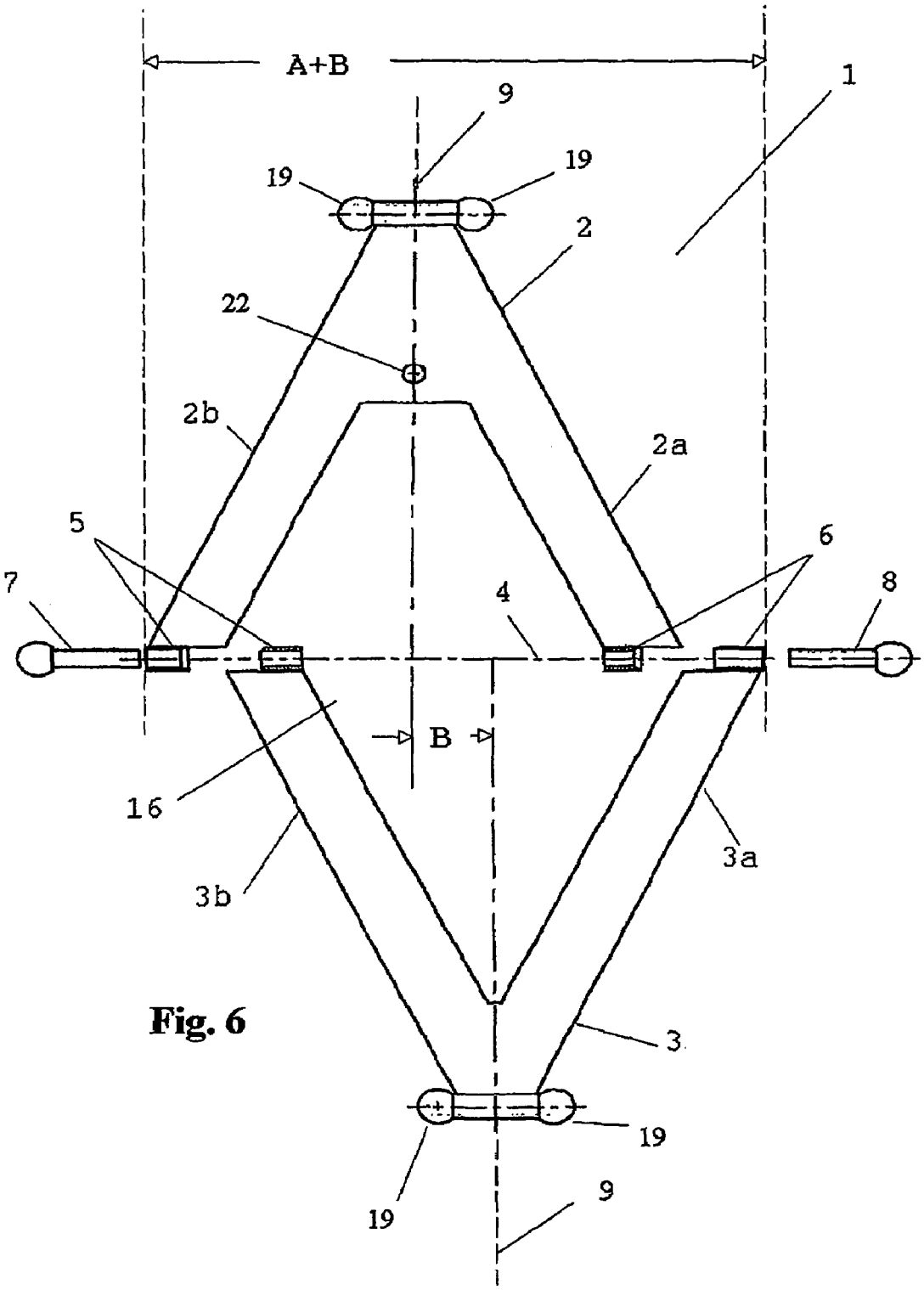
FIG. 6 shows the lamp frame of FIG. 5 disassembled.
Figure 14:
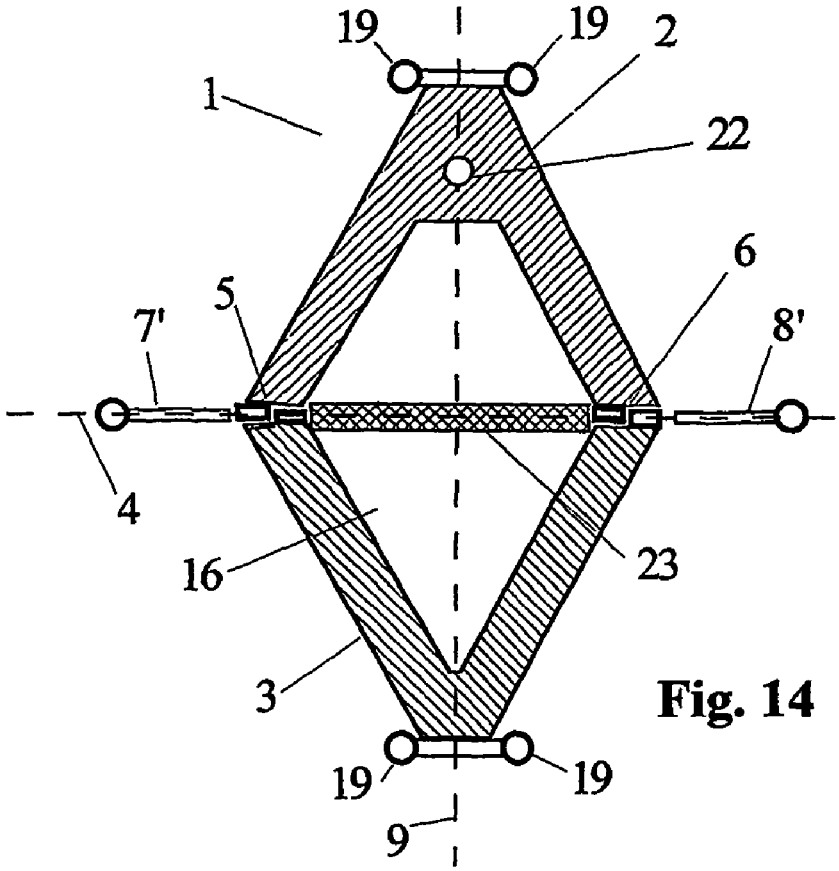
FIGS. 14 and 15 show the lighting system of FIGS. 9 and 10 adapted as a table lamp.
Figure 15:
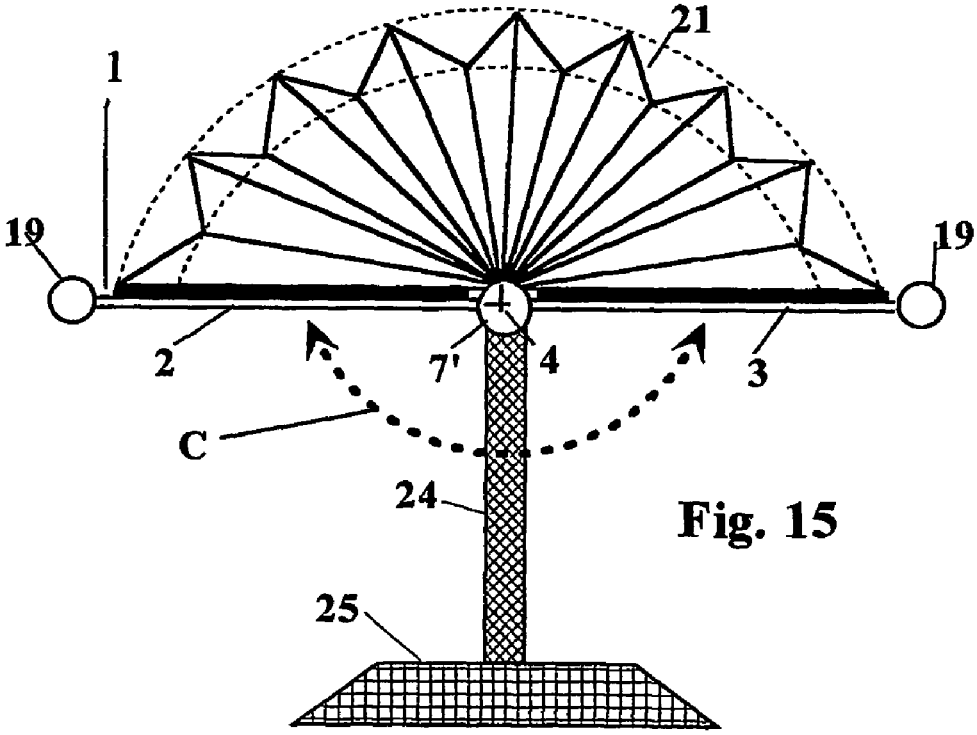

As shown in FIGS. 5 through 7 the preferred embodiment of the lamp frame 1 comprises a pair of co-operating planar elements 2 and 3 which articulate about main axis 4 relative to one another as at co-axial hinges 5 and 6 to an angle C of 180 degrees (not shown, see FIGS. 14 and 15).

Each of components 2 and 3 are generally V-shaped with extended leg portions 2*a*, 2*b* and 3*a*, 3*b* respectively forming central open space 16.

Restraining bolts 7 and 8 provide alternatively for co-axial rotation of components 2 and 3 respectively about axis 4 and, upon tightening, relative fixation thereof at angle C.

In FIG. 5, lamp frame 1 is shown with components 2 and 3 assembled into their respective attached positions forming hinges 5 and 6 along the axis 4 and with an overall width designated A.

Element 2 is shown with an attachment hole 22 where a lamp may be affixed in a standard fashion but preferably with the illuminating portion extending into space 16.

In FIG. 6 the lamp frame 1 is shown disassembled with components 2 and 3 laterally displaced in the amount designated B while remaining aligned along axis 4. Restraining bolts 7 and 8 are also shown aligned with axis 4 ready for insertion into their respective hinges 5 and 6 by the user.

As can be seen in FIG. 6 the lamp frame 1 of the preferred embodiment is readily assembled by the user by aligning hinges 5 and 6 along their mutual axis of rotation 4 for lateral displacement B rather than in a transverse manner along axis 9-9'.

Facing leg portions of components 2 and 3 provide for flexibility of components 2 and 3 along axis 4 thus providing for a higher tolerance to manufacturing differences while minimising deformation resistance along axis 4. A large central open area 16 is also provided. Area 16 accommodates lamps of various sizes without undue interference in illumination patterns over a wide variety of positions and uses of lamp frame 1.

At FIGS. 7 and 8 are shown two alternative embodiments of the details of hinges 5 and 6, of which FIG. 7 shows the preferred configuration.

In FIG. 7 hinges 5 and 6 are provided with hinge elements 10, 11 and 12, 13 respectively. Each of hinge elements 10 through 13 are secured to respective leg portions 2*a*, 2*b*, 3*a*, 3*b* as by welding as noted at 10*a*, 11*a*, 12*a* and 13*a* respectively.

Each of elements 11 and 12 are formed of thick wall tubing and are internally threaded as at 11*b* and 12*b* respectively. Preferably bolts 7 and 8 extend inwards and are formed of a removable end 17 and threaded rod 18 which engages threaded elements 11 and 12 laterally along axis.

Hinge elements 10 and 13 are formed of thin wall tubing and are free to rotate about rod 18.

Each of hinge elements 10 through 13 is provided with a conical surface of engagement as at 10*c*, 11*c*, 12*c* and 13*c*. As bolts 7 and 8 are tightened the hinge elements 10 through 13 are laterally displaced for a high friction and/or deforming engagement contact between conical surfaces 10*c*, 11*c* and 12*c*, 13*c* respectively with relatively low user torque applied to ends 17 or either of them.

In FIG. 8 shows an alternative configuration for the hinge components. In this Figure hinge elements 10 and 11 are the same as those shown in FIG. 7 and are attached to legs 2*a* and 3*a* in the same manner. Hinge elements 12 and 13 (FIG. 7) have been replaced with elements 14 and 15 respectively which are generally the same but for a reversal of the angles of the conical surfaces of engagement at 14*c* and 15*c*. Hinge 6 in FIG. 8 operates in conjunction with bolt 8 in the same fashion as that in FIG. 7.

Restraining bolts 7 and 8 are shown with spherical heads as they are adapted to be tightened by hand and serve as points of attachment and decorative feet or stand-offs in various configurations.

Similarly, detachable spherical elements 19 are provided at other extremities of the lamp frame 1. Elements 19 may be utilised for attachment of accessories for various mounting configurations as required.

Figure 9:
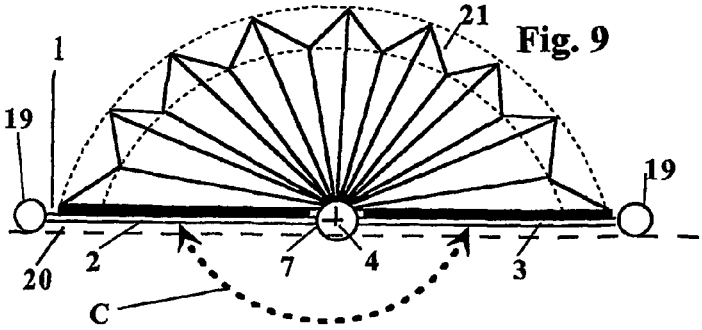
FIGS. 9 and 10 show the lamp frame of FIG. 5 with a fan-shaped decorative element installed in both side and plan view respectively.
Figure 10:
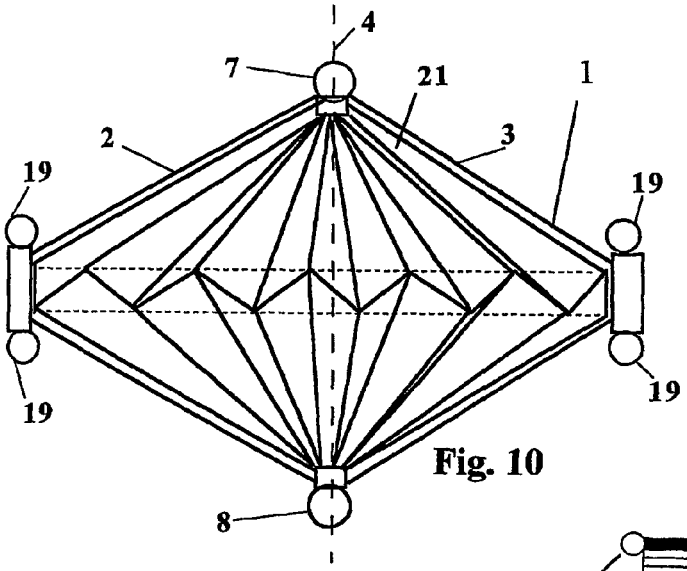
Figure 11:
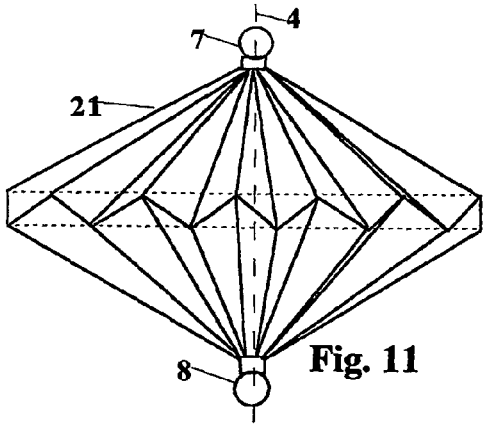
FIG. 11 shows the lighting system of FIGS. 9 and 10 in fully open position.

In the preferred embodiment lamp frame 1 is provided with a accordion-fan-shaped shade 21 as depicted in FIGS. 9, 10 and 11 which may be fabricated from paper or other suitable material.

In FIGS. 9 and 10 the lamp frame 1 is shown with components 2 and 3 arranged in a extended co-planar manner (angle C of 180 degrees) for arrangement on a planar surface such as a table or wall as at 20 in a manner as shown in FIGS. 5 and 6. Stand-offs 19 and bolts 7 and 8 (not shown) space the frame from the planar surface 20.

Alternatively, lamp frame 1 may be arranged with components 2 and 3 fully rotated and overlapping to adapt the frame to the form of a hanging or table lamp as shown in FIG. 11 (in this case angle C is 360 degrees). As may be appreciated in this form, as with others, central interior open space 16 permits a lamp attached at hole 22 (FIGS. 5, 6 and 13) to provide for uniform and full capacity lighting over substantially the whole of the surface of the lamp shade 21 in its various configurations.

Figure 12:
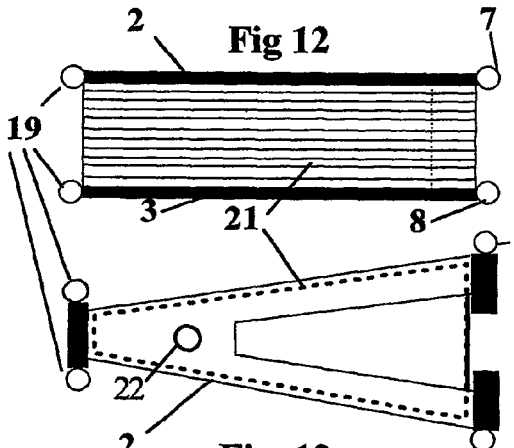
FIGS. 12 and 13 show the lighting system of FIGS. 9 and 10 fully closed with the clamping hinges released and ready for packaging or storage.
Figure 13:
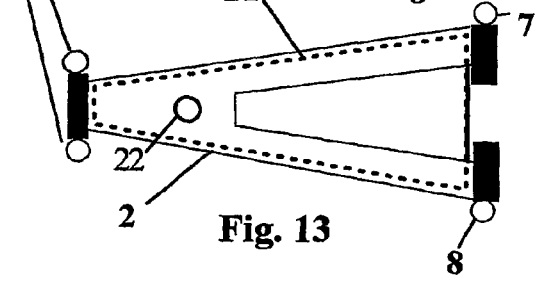

FIGS. 12 and 13 show an assembled lamp frame 1 and accordion-fan shade 21 in fully closed position as would be useful for packaging, shipping or merely storage in both a side view, FIG. 12, and a plan view, FIG. 13. Hinge elements 10 through 13 would be disassembled by removal of bolts 7 and 8 which may be reinserted into the threaded elements 11 and 12 so that the lamp frame and shade may remain tact. This disassembly permits the accordion-fan shade 21 and lamp frame 1 to fully close and compact their size and provide for a low damage configuration fully protective of the shade 21.

FIGS. 14 and 15 show the lamp frame 1 and fully assembled lighting system configured as a table lamp. In FIG. 14 the lamp frame 1, as shown in FIG. 5, (numbers correspond) is provided with extended bolts 7' and 8' which are adapted to pass through hinges 5 and 6 and fixably engage a central axle 23. Tightening of bolts 7' and 8' fixes elements 2 and 3 in a co-planar configuration (angle C at 180 degrees) to axle 23. Angle C may be adjusted for function or decorative impact to less or more than 180 degrees as desired.

As can be seen in FIG. 15, axle 23 is provided with central support 24 and 25. Fixation of the axle 23 in relation to the lamp frame 1 renders the fully assembled lighting fixture and shade 21 as a table lamp.

Figure 16:
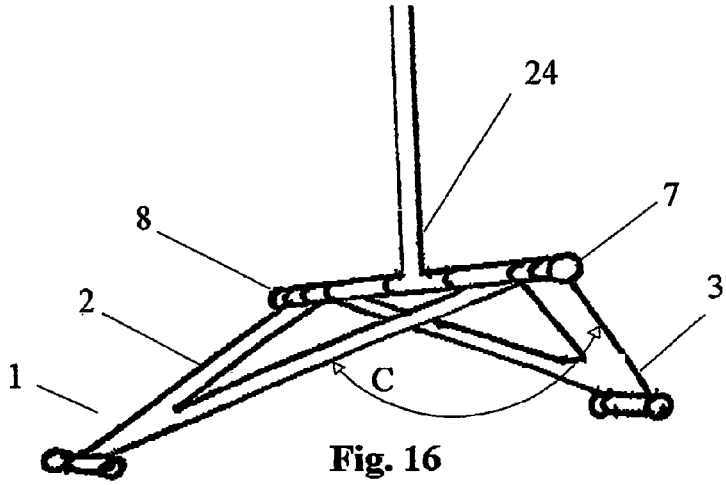
FIGS. 16 through 18 show the lamp frame of FIGS. 5 and 6 in other configurations
Figure 17:
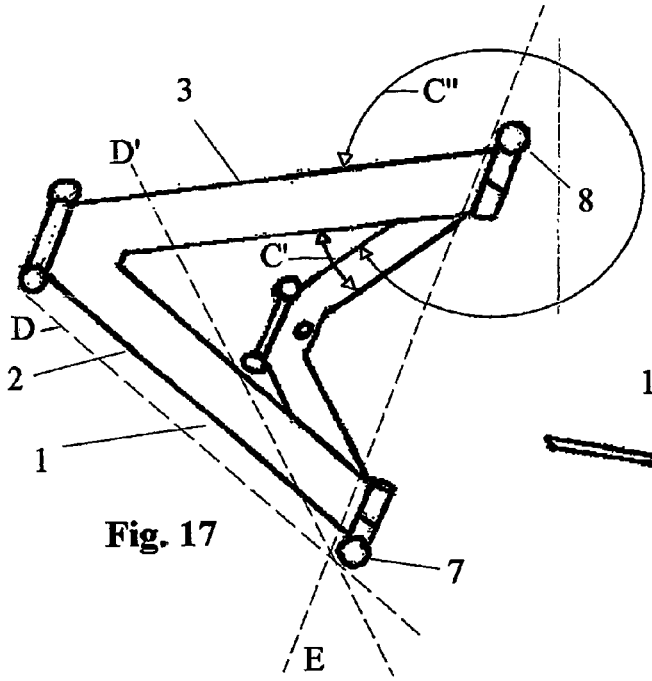
Figure 18:
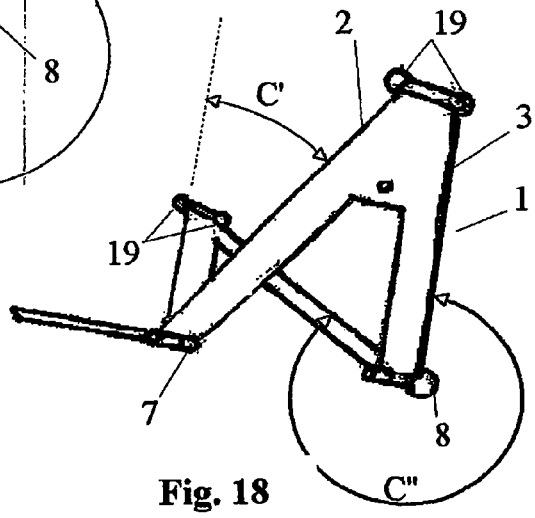

At FIGS. 16 through 18 further configurations of the preferred embodiment are shown. FIG. 16 shows angle C adjusted to less than 180 degrees and central support 24 adapted to provide a ceiling fixture. Again, angle C may be more or less than 180 degrees.

In FIGS. 17 and 18 the lamp frame 1 is adjusted with angle C either less than 90 degrees, as at C', or more than 90 degrees, as at C". In this configuration with the shade on either side, the lighting system may be a free standing table lamp resting along axes D and D' or may be attached to either an open or a closed corner between 2 walls along axis E. Further, attachment F may be added at bolts 7, 8 or 19 to further extend available configurations. One such embodiment is provided by a pair of wall brackets attached at 19 for secure fixation to a planar surface. Security features may be conveniently added to prevent tampering with the connection of the lighting system to the surface.

It will be apparent to those skilled in the art that the foregoing is illustrative. Numerous modifications and other embodiments are within the scope of one of ordinary skill in the art.

What I claim is:

1. A lighting system comprising:

an articulating lamp frame means including:

an open central area, a pair of substantially planar v-shaped components attached together at an open end thereof to form said open central area by a pair of spaced apart hinge means for relative rotation about a main axis extending between said hinge means and across said central area, wherein a support means supporting a lamp is provided on one of said planar v-shaped components and adjacent said central area, and said hinge means including fixation means for releasably fixing the relative position of said planar components; and an extensible shade means attached between said planar components.

2. A lighting system as claimed in claim 1 wherein each of said hinge means comprises a pair of hinge elements aligned along said main axis attached to a respective one of said components.

3. A lighting system as claimed in claim 2 wherein said fixation means includes threaded bolt means for forming an axle of said hinge means.

4. A lighting system as claimed in claim 3 wherein each of said pair of hinge elements includes a threaded portion to receive said bolt means and apply compressive force to said hinge means along said main axis and to fix the relative position of said planar components upon tightening of said bolt means.

5. A lighting system as claimed in claim 4 wherein said threaded portions are adjacent said open central area.

6. A lighting system as claimed in claim 4 wherein each of said hinge means includes a pair of non-axial contact surfaces that come into frictional contact upon said tightening.

7. A lighting system as claimed in claim 6 wherein each of said contact surfaces lie between said hinge elements.

8. A lighting system as claimed in claim 6 wherein said contact surfaces comprise respective pairs of conical surfaces that fit one within the other.

9. A lighting system as claimed in claim 1 wherein said hinge means further comprises means adapted to guide said planar components together by movement along said main axis upon attachment.

10. A lighting system as claimed in claim 1 wherein said pair of substantially planar v-shaped components each include a detachable spherical element provided at a narrow end thereof for one of attachment of an accessory or a mounting configuration.

11. A lighting system as claimed in claim 10 wherein said mounting configuration includes configuration as a table, swag lamp, or plural lamps.

12. A lighting system comprising:

an articulating lamp frame means including:

a pair of substantially planar v-shaped components attached together at an open end thereof by a pair of spaced apart hinge means for relative rotation about a main axis extending between said hinge means, wherein a support means supporting a lamp and is provided on one of said planar v-shaped components, and each of said hinge means comprises:

a pair of hinge elements aligned along said main axis attached to a respective one of said components, fixation means for releasably fixing the relative position of said planar components, and means adapted to guide said planar components together along said main axis upon attachment; and an extensible shade means attached between said planar components.

13. A lighting system as claimed in claim 12 wherein said fixation means includes threaded bolt means for forming an axle of said hinge means.

14. A lighting system as claimed in claim 13 wherein each of said pair of hinge elements includes a threaded portion to receive said bolt means and apply compressive force to said hinge means along said main axis and to fix the relative position of said planar components upon tightening of said bolt means.

15. A lighting system as claimed in claim 14 wherein said threaded portions are adjacent the other of said hinge means.

16. A lighting system as claimed in claim 14 wherein each of said hinge means includes a pair of non-axial contact surfaces that come into frictional contact upon said tightening.

17. A lighting system as claimed in claim 16 wherein each of said contact surfaces lie between said hinge elements.

18. A lighting system as claimed in claim 16 wherein said contact surfaces comprise respective pairs of conical surfaces that fit one within the other.

19. A lighting system as claimed in claim 12 wherein said pair of substantially planar v-shaped components each include a detachable spherical element provided at a narrow end thereof for one of attachment of an accessory or a mounting configuration.

20. A lighting system as claimed in claim 19 wherein said mounting configuration includes configuration as a table, swag lamp, or plural lamps.

21. A lighting system comprising:

an articulating lamp frame means including:

an open central area, a support means supporting a lamp adjacent said central area, a pair of substantially planar components attached together for use by a pair of spaced apart hinge means for relative rotation about a main axis extending between said hinge means and across said central area, and said hinge means including fixation means for releasably fixing the relative position of said planar components; and an extensible shade means attached between said planar components, wherein each of said hinge means comprises a pair of hinge elements aligned along said main axis attached to a respective one of said components, wherein said fixation means includes threaded bolt means for forming an axle of said hinge means, wherein each of said pair of hinge elements includes a threaded portion to receive said bolt means and apply compressive force to said hinge means along said main axis and to fix the relative position of said planar components upon tightening of said bolt means, wherein each of said hinge means includes a pair of non-axial contact surfaces that come into frictional contact upon said tightening, and wherein said contact surfaces comprise respective pairs of conical surfaces that fit one within the other.

22. A lighting system as claimed in claim 21 wherein said pair of substantially planar v-shaped components each include a detachable spherical element provided at a narrow end thereof for one of attachment of an accessory or a mounting configuration.

23. A lighting system as claimed in claim 22 wherein said mounting configuration includes configuration as a table, swag lamp, or plural lamps.

24. A lighting system comprising:

an articulating lamp frame means including:

support means to support a lamp, a pair of substantially planar components attached together for use by a pair of spaced apart hinge means for relative rotation about a main axis extending between said hinge means, and each of said hinge means comprises:

a pair of hinge elements aligned along said main axis attached to a respective one of said components, fixation means for releasably fixing the relative position of said planar components, and means for guiding said planar components together along said main axis upon attachment; and an extensible shade means attached between said planar components, wherein said fixation means includes threaded bolt means for forming an axle of said hinge means, wherein each of said pair of hinge elements includes a threaded portion to receive said bolt means and apply compressive force to said hinge means along said main axis and to fix the relative position of said planar components upon tightening of said bolt means, wherein each of said hinge means includes a pair of non-axial contact surfaces that come into frictional contact upon said tightening, and wherein said contact surfaces comprise respective pairs of conical surfaces that fit one within the other.

25. A lighting system as claimed in claim 24 wherein said pair of substantially planar v-shaped components each include a detachable spherical element provided at a narrow end thereof for one of attachment of an accessory or a mounting configuration.

26. A lighting system as claimed in claim 25 wherein said mounting configuration includes configuration as a table, swag lamp, or plural lamps.

* * * * *